US005662322A

United States Patent [19]

Kawaguti

[11] Patent Number: 5,662,322

[45] Date of Patent: Sep. 2, 1997

[54] ACCUMULATING APPARATUS FOR SHEET-LIKE HOLDERS FOR A PLURALITY OF NEGATIVE FILM STRIPS

[75] Inventor: Masuo Kawaguti, Wakayama, Japan

[73] Assignee: Noritsu Koki Co., Ltd., Wakayama-ken, Japan

[21] Appl. No.: 413,817

[22] Filed: Mar. 17, 1995

[30] Foreign Application Priority Data

Mar. 24, 1994 [JP] Japan ..... 6-053384
Feb. 8, 1995 [JP] Japan ..... 7-020377

[51] Int. Cl.[6] ..... B65H 29/46; B65H 31/26

[52] U.S. Cl. ..... 271/84; 271/180; 271/209; 271/220

[58] Field of Search ..... 271/84, 85, 180, 271/189, 191, 200, 209, 220

[56] References Cited

U.S. PATENT DOCUMENTS

| | | | |
|---|---|---|---|
| 516,386 | 8/1894 | Wood | 271/191 |
| 4,068,839 | 1/1978 | Bullock et al. | 271/180 |
| 4,284,462 | 8/1981 | Heine | 271/84 X |
| 4,974,394 | 12/1990 | Suzuki | 53/435 |
| 5,098,079 | 3/1992 | Sanborn, III | 271/220 X |
| 5,159,385 | 10/1992 | Imamura | 355/28 |

FOREIGN PATENT DOCUMENTS

| | | | |
|---|---|---|---|
| 62-39000 | 10/1987 | Japan . | |
| 56327 | 3/1994 | Japan | 271/220 |
| 156844 | 6/1994 | Japan | 271/180 |

*Primary Examiner*—Boris Milef
*Attorney, Agent, or Firm*—Felfe & Lynch

[57] ABSTRACT

The apparatus includes a retaining section for retaining the film holder in a suspended state and having a pair of retainer units disposed adjacent the feeding section and arranged one after another in a direction of transporting the film holder for retaining a rear end of the film holder respecting its transporting direction, and a retaining section driver unit for selectively driving the pair of retainer units to a retaining position or to a non-retaining position. When the retaining section is about to receive the film holder from the feeding section, the retaining section driver unit drives only one of the retainer units to the non-retaining position. Whereas, when the retaining section has received the film holder, the retaining section driver unit switches over the one retainer unit from the non-retaining position to the retaining position and also switches over the other retainer unit from the retaining position to the non-retaining position.

10 Claims, 14 Drawing Sheets

PRIOR ART

ACCUMULATING APPARATUS FOR SHEET-LIKE HOLDERS FOR A PLURALITY OF NEGATIVE FILM STRIPS

BACKGROUND OF THE INVENTION

1. Field of the invention

The present invention relates to an accumulating apparatus for accumulating a negative film sheet-like holder fed from a feeding section for feeding the negative film holder in a direction transverse to an arrangement of film strips within the holder, the holder being capable of holding a plurality of negative film strips in parallel.

2. Description of the Related Art

An accumulating apparatus for a negative film holder of the above-noted type is operable to accumulate a plurality of sheet-like negative film holders 3 each of which holds a plurality of negative film strips 2 within a number of rows of pockets corresponding to the number of film strips in FIG. 3. Each film strip includes four to six frames and each film holder has been cut to have a certain number of rows of film pockets (the number corresponds, in general, to the number of film strips constituting together one 'order' from the customer).

A conventional means or method for accumulating the above-described film holders is known from e.g. a Japanese published utility model gazette No. 62-39000.

That is, as shown in FIGS. 19(*a*) and (*b*), as a guide 150 capable of supporting right and left sides of a film holder 3 receives the film holder 3 holding film strips 2 from the feeding section, an endless belt 151 is driven to pull in this film holder 3 with the holder being maintained flat. With completion of this pull-in operation, as illustrated in FIG. 19(*c*), a lift bar 152 is lowered to drop the film holder 3 onto a stacker tray 153 disposed horizontally. Thereafter, as illustrated in FIG. 19(*d*), the lift bar 152 is raised to its original position for receiving a next film holder 3. In this manner, a plurality of sheet-like film holders 3 are stacked one on another with the holders being extended flat. Incidentally, according to the construction disclosed in the above-cited reference, the film holder 3 is caused to slide by its own weight. Whereas, the construction shown in FIG. 19 is modified such that the holder 3 is forcibly transported by means of the endless belt 151.

With the above-described conventional construction, however, the film holders are horizontally stacked in the flatly extended state, so that the stacker tray needs to be sized to accommodate the length of the holder in the transportation direction thereof. As a result, the entire accumulating apparatus tends to be enlarged. Hence, improvement has been desired in this respect.

The present invention addresses the above-described state of the art. A first object of the present invention is to provide an accumulating apparatus for a negative film holder which apparatus may reduce the space required for accumulating the negative film holders.

A second object of the invention is to achieve the first object while simplifying the construction for accumulating the negative film holders.

A third object of the invention is to achieve the first or second object while assuring stability of operations of the negative film holder accumulating apparatus.

SUMMARY OF THE INVENTION

For fulfilling the above object, an accumulating apparatus for a sheet-like negative film holder, includes a retaining section for retaining, in a suspended state, the film holder fed from a feeding unit, the film holder being capable of holding a plurality of negative film strips parallel;

The retaining section includes a pair of retainer units disposed adjacent the feeding section and arranged one after another in a direction of transporting the film holder for retaining a rear end of the film holder with respect to the transporting direction. It further includes a drive for selectively driving the pair of retainer units either to a retaining position or to a non-retaining position.

When the retaining section is about to receive the film holder from the feeding section, the retaining section drive drives only one of the retainer units to the non-retaining position.

When the retaining section has received the film holder, the retaining section drive switches over the one retainer unit from the non-retaining position to the retaining position and also switches over the other retainer unit from the retaining position to the non-retaining position.

When the film holder holding film strips is fed from the feeding section to the retaining section, the retaining section receives this film holder with one of the retainer units arranged one after another in the holder transporting direction being set at the non-retaining position while the other retainer unit being set at the retaining position.

After the retaining section has received the film holder, the retaining section drive switches over the one retainer unit from the non-retaining position to the retaining position, so that this retainer unit retains the rear end of the film holder with respect to the holder transporting direction. That is to say, the retainer unit retains the film holder in a suspended state.

When the film holder has been just received, the other retainer unit currently set to the retaining position does not retain this sheet holder. After the reception of the film holder, this retainer unit is switched over to the non-retaining position. Then, the apparatus becomes ready for retaining the received film holder or a film holder to be received next.

That is to say, the two retainer units do not assume the non-retaining position simultaneously. Rather, as these retainer units are alternately switched over between the retaining position and the non-retaining position respectively, rear ends of the film holders are retained, so that the sheet-like film holders are retained in a suspended state.

As a result, since the film holders are retained in a suspended manner with the rear ends thereof with respect to the film holder transporting direction being retained, the invention has achieved a negative film holder accumulating apparatus which may reduce the space required for accumulation of the negative film holders.

According to one aspect of the present invention, one of the pair of retainer units disposed on the downstream side relative to the other with respect to the film holder transporting direction is switched over between the retaining position and the non-retaining position in association with a movement of the film holder. The other retainer unit disposed on the upstream side with respect to the transporting direction is switched over between the retaining position and the non-retaining position in association with a movement thereof to the upstream side of the transporting direction.

When the retaining section is about to receive the film holder from the feeding section, the retaining section drive means drives the downstream retainer unit to the non-retaining position; and when the retaining section has received the film holder, the retaining section drive means switches over the downstream retainer unit from the non-retaining position to the retaining position and also switches over the upstream retainer unit from the retaining position to the non-retaining position.

With the above construction, when the retaining section is about to receive the film holder from the feeding section, the retainer unit disposed on the downstream side in the film holder transporting direction is set to the non-retaining position its movement in the direction of the thickness of the, so that the film holder fed from the feeding section may slide under the retainer unit set at the non-retaining position.

After reception of the film holder, the retainer unit is switched over from the non-retaining position to the retaining position, thereby to retain the received film holder in a suspended state.

On the other hand, the upstream retainer unit, which is set at the retaining position when the film holder is about to be received, is switched over to the non-retaining position after the reception of the film holder, so that the apparatus becomes ready for retaining the received film holder or for retaining a film holder to be received next.

Namely, the retainer unit disposed on the downstream side in the film holder transporting direction is to retain a portion of the film holder which is closer to the center thereof than a portion of the holder to be retained by the upstream retainer unit. Then, if the downstream retainer unit were interposed between the film holder already retained by this retainer unit and the further film holder newly fed from the feeding section, an arrangement would be needed for e.g. withdrawing this retainer unit away from the film holder transporting passage, thereby to render the construction of the retaining section drive means complicated. On the other hand, the above-described construction may reliably retain the received film holder with the simple arrangement of allowing the retainer unit to be moved in the direction of the thickness of the film holder.

Moreover, the upstream retainer unit retains the portion of the film holder closer to the rear edge thereof than the portion of the same retained by the downstream retainer unit. Then, by utilizing this, this retainer unit becomes ready for retaining the newly received film holder simply by being moved to the upstream side in the transporting direction.

As a result, the downstream retainer unit and the upstream retainer unit may be switched over between the retaining position and the non-retaining position simply with the movement in the direction of the thickness of the film holder and with the movement to the upstream side in the transporting direction, respectively. Hence, the construction of the retaining section drive means for driving these two retainer units may be simple.

According to a further aspect of the present invention, the retaining section includes a film holder receiving table for supporting the film holder retained by the retainer units, the film holder receiving table being downwardly inclined to the downstream side of the film holder transporting direction.

With this construction, the film holder receiving table for supporting the film holder retained by the retainer units is inclined. Then, when the film holders are retained in the suspended state, the load of these film holders may be born not only by the retainer units but also by the inclined film holder receiving table. Accordingly, in comparison with a construction in which the load of the film holders is born only by the retainer units, the above-described construction allows the retainer units to have a relatively weak retaining force, whereby the construction of the retaining section drive means for driving the retainer units may be further simplified.

According to a still further aspect of the present invention, the film holder receiving table includes a horizontal portion which faces the two retainer units, the horizontal portion being overlapped, in a plan view, with the feeding section and disposed downwardly of the feeding section.

With the above construction, the horizontal portion of the film holder receiving table is overlapped with the feeding section in the plan view and disposed downwardly of the same. Hence, this allows reduction of the size of the apparatus in the plan view.

Further, since the retainer units are disposed in opposition to the horizontal portion of the film holder receiving table, so that, in comparison with a construction without the horizontal portion of the film holder receiving table, the above construction restricts upward extension of the retainer units, whereby the apparatus may be formed compact in the side view thereof as well.

Consequently, with the size reduction of the apparatus in the plan view as well as the size reduction of the same in the side view, it becomes possible to further reduce the space required for accumulating the film holders.

According to a still further aspect of the present invention, the feeding section includes a film holder support body which is movable in the film holder transporting direction; and the apparatus further comprises feeding section drive means for driving the film holder support body between a supporting position for supporting the film holder fed at a downstream position relative to the film holder transporting direction and a non-supporting position for releasing the support of the film holder at an upstream position relative to the film holder transporting direction. The feeding section drive means switches over the film holder support body from the supporting position to the non-supporting position when the rear end of the film holder relative to the film holder transporting direction is located on the film holder support body.

With the above-described construction, when the film holder is fed from the feeding section and the rear end of this film holder is supported on the film holder support body, with driving of the film holder support body from the supporting position to the non-supporting position, the rear end of the film holder is allowed to drop onto the horizontal portion of the film holder receiving table.

As described hereinbefore, the feeding section is overlapped in the plan view with the horizontal portion of the film holder receiving table. Thus, if the feeding section completely fed the film holder until its very rear end, the rear end of the holder dropped from the feeding section would be bent, so that it may not properly fall onto the retainer units facing the horizontal portion of the film holder receiving table. Then, according to the above-described construction, the rear end of the film holder is allowed to drop in association with the switching-over of the support body, so that the rear end of the film holder may be dropped properly onto the disposing position of the retainer unit.

As a result, as the film holder may be dropped properly onto the disposing position of the retainer unit, the film holder may be retained reliably and the entire accumulating apparatus may function in a stable manner.

According to a still further aspect of the invention, the retaining section drive means and the feeding section drive means include a single actuator and a coupling mechanism for coupling between the retainer units and the film holder support body.

With the above-described construction, the two retainer units and the film holder support body are driven via the coupling mechanism by the single actuator. Thus, in comparison with a construction in which a plurality of actuators are provided for respectively driving the two retainer units and the film holder support body, the above-described construction may be simplified.

As a result, the construction of the entire film holder accumulating apparatus may be further simplified.

According to a still further aspect of the invention, the coupling mechanism comprises a cable coupling mechanism.

With the above, since the coupling mechanism comprises a cable coupling mechanism, this construction may be more simple than a construction in which the coupling mechanism is comprised of e.g. combination of gears. Consequently, the construction of the entire film holder accumulating apparatus may be further simplified.

According to a still further aspect of the invention, the coupling mechanism comprises a cam coupling mechanism.

This construction is advantageous in that after use for an extended period of time the construction suffers fewer problems in the coupling mechanism such as deformations, so that the two retainer units and the film holder support body may operate in a reliable manner for an extended period of time.

As a result, the construction achieves the effect that the entire accumulating apparatus may operate reliably.

According to a still further aspect of the invention, the apparatus further comprises a single actuator for driving both the feeding section drive means and the retaining section drive means; a first link mechanism for mechanically linking the drive of the actuator and the position switching-over of the film holder support body; and a second link mechanism for mechanically linking the drive of the actuator and the position switching-over of the retaining section.

With the above-described construction, the drive of the actuator and the position switching-over of the film holder support body and also the drive of the actuator and the position switching-over of the retaining section are respectively linked to each other via the mechanical link mechanisms. Then, in comparison with a further construction in which the above are linked via cables or linked electrically, the above-described construction is advantageous in that the construction may be readily assembled with setting the position switching-over of the film holder support body and the position switching-over of the retaining section to predetermined switching timings respectively.

Further, since the single common actuator is provided for driving both the feeding section drive means and the retaining section driving means, the respective switching timings of the film holder support body and the retaining unit may be set with reference to the single common actuator. Further, the first link mechanism and the second link mechanism are provided separately for linking between the drive of the actuator and the position switching-over of the film holder support body and for linking between the drive of the actuator and the position switching-over of the retaining section. Thus, when the switch-over timing of one of the first and second link mechanisms is adjusted, this adjustment hardly affects the switching-over timing of the other link mechanism.

Consequently, .the above-described construction facilities the assembly of the construction with setting the position switching-over of the film holder support body and the position switching-over of the retainer units to respective predetermined switch-over timings, so that the manufacture and maintenance operation of the apparatus may be further facilitated.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of a film holder accumulating apparatus of the invention as applied with an automatic film inserting system will be described in details with reference to the accompanying drawings.

Figure 1:
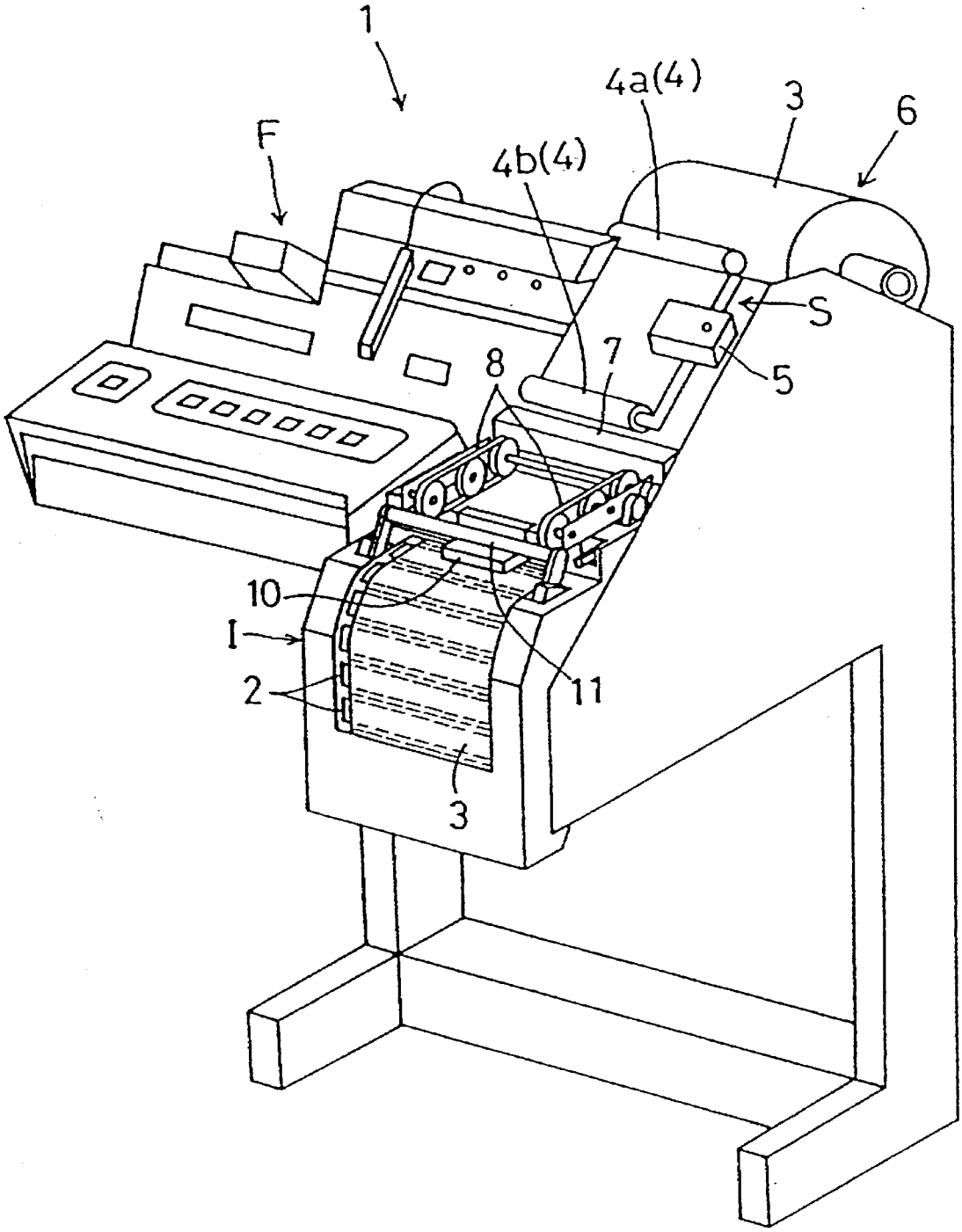
FIG. 1 is a perspective view showing an outer appearance of an apparatus relating to one preferred embodiment of the present invention.
Figure 2:
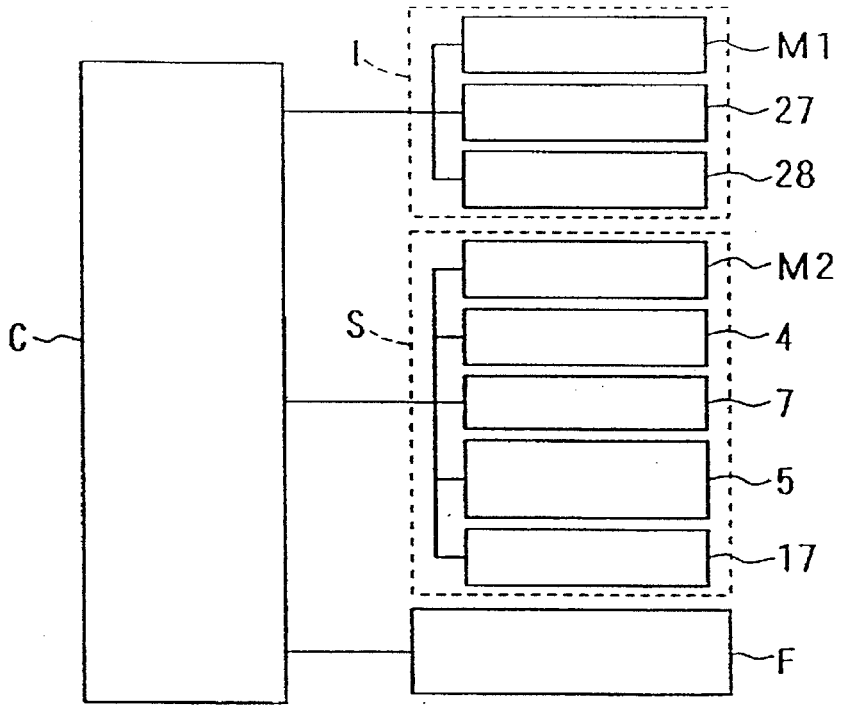
FIG. 2 is a view showing a construction of a controller of the apparatus shown in FIG. 1.
Figure 3:
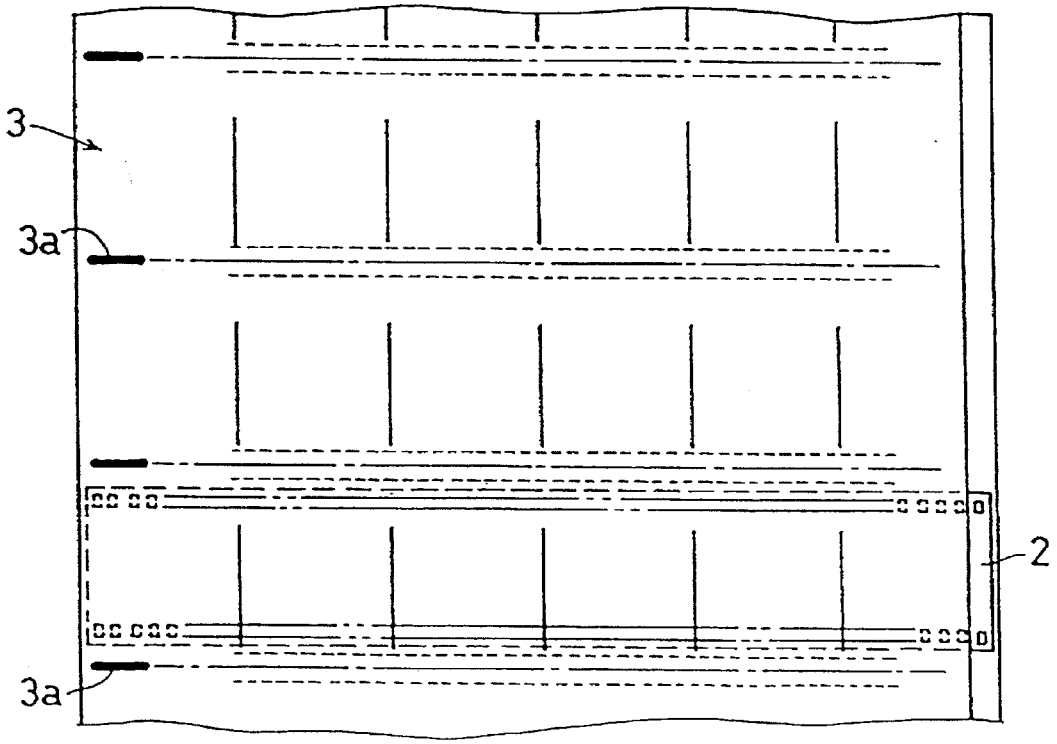
FIG. 3 is view showing a sheet-like negative film holder to be used with the apparatus of FIG. 1.

This automatic film inserting system 1 is operable to automatically insert a developed film 2 into a sheet-like film holder 3. The film has been cut into a plurality of film strips each containing four or six frames, and the holder holds these film strips as arranged side by side along the length thereof, as shown in FIG. 3. As shown in FIG. 1, the system includes a film positioning-transporting section F, a holder positioning-transporting section S, a retaining section I for retaining and accumulating the film holder and also a controller C shown in FIG. 2.

Though not shown, the film positioning-transporting section F includes a film housing for housing the developed film 2 in a rolled state, transporting rollers for withdrawing and transporting the film 2 from the film housing, an image sensor comprised of an optical sensor for sensing an image-bearing portion of the film 2 and a film cutter for cutting the film 2 in the direction normal to the transporting direction of the film 2.

When the developed film 2 is fed in the rolled state into the film housings the system starts counting the number of frames being transported based on the detection by the image sensor. Then, after transportation of six or four frames counted, the transporting operation of the film is suspended, so that the film cutter cuts an inter-frame margin of the film. This cut film 2 or film strip is further transported to reach the holder positioning-transporting section S.

The holder positioning-transporting section S includes a film holder feeding unit 6 for holding the sheet-like negative film holder 3 in a rolled state, transporting rollers 4 for withdrawing and transporting the film holder 3 from the holder feeding unit 6 in the direction of arrangement of the film strips 2 in the film holder 3, a mark sensor 5 for sensing a mark provided at an intermediate portion between adjacent rows of pockets provided in the holder 3 for housing the film strips 2 therein respectively, a holder cutter 7 for cutting the intermediate portion between the adjacent rows of pockets housing the film strips 2 and transporting belts 8 for transporting the film holder 3 having passed the the holder cutter 7 to the retaining section I. Accordingly, the downstream end of the transporting belts 8 with respect to the transporting direction of the film holder functions as a feeding section O for feeding the negative film holder 3 in the direction of the arrangement of the film strips held therein.

Figure 5:
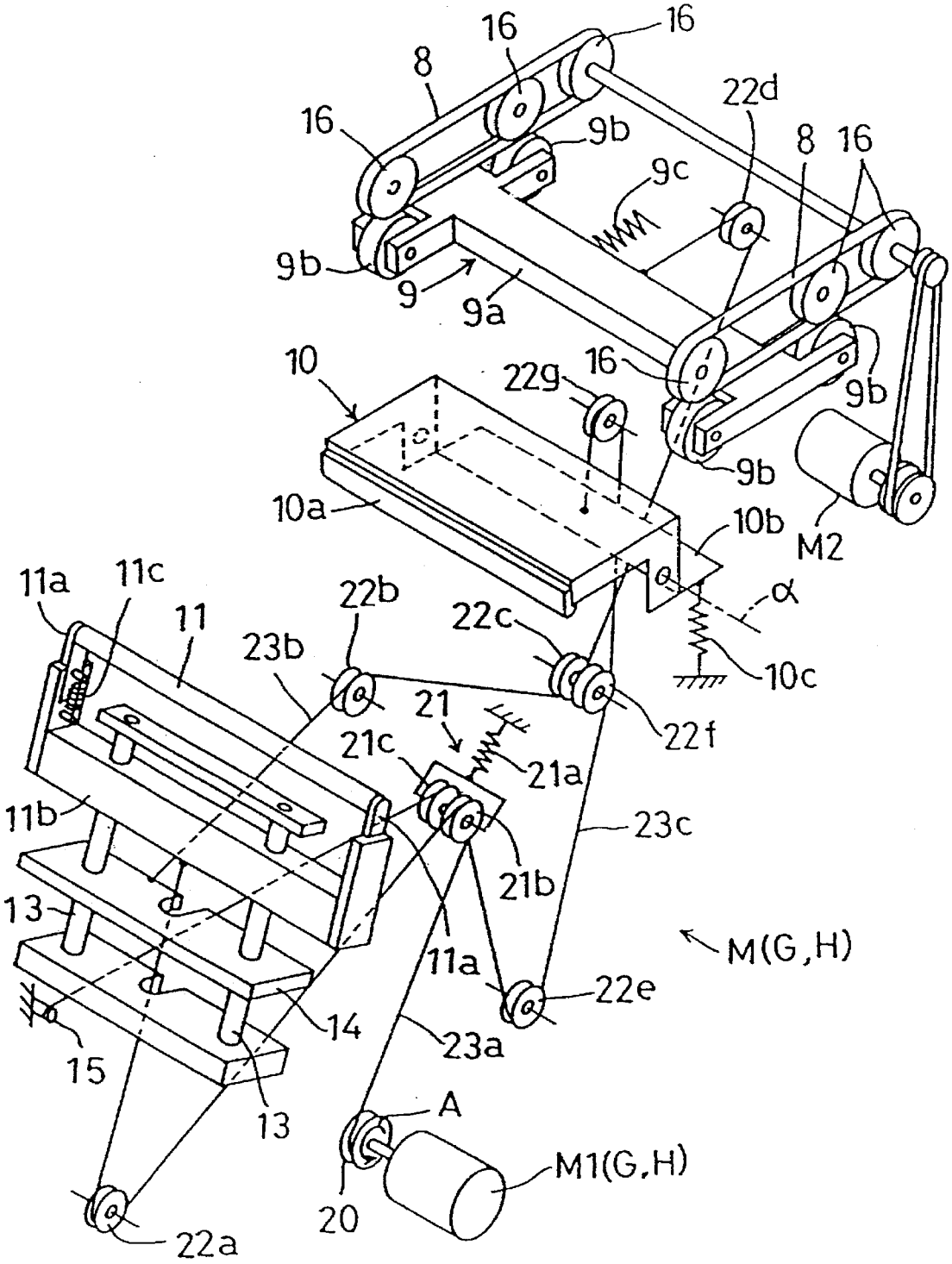
FIG. 5 is a schematic view showing the construction of the major portions of the apparatus shown in FIG. 1.

As best shown in FIG. 5, the transporting belts 8 are entrained about three pairs of right and left rollers 16, and the rollers 18 positioned upstream relative to the film holder transporting direction are driven to rotate by a motor M2 via a drive belt. Further, as shown in FIG. 6, adjacent the transporting belts 8, there is provided a rear-end sensor 17 for sensing a rear end of the film holder 3, so that the motor M2 is stopped to temporarily stop the transportation of the film holder 3 before this film holder 3 exits from the feeding section O completely.

The feeding section O includes a film holder support body 9 operable to support from under the film holder 3 transported and pressing the holder against the transporting belts 8, and this support body 9 is movable along the film holder transporting direction by means of an unillustrated guide secured to a casing 12. The film holder support body 9 includes a frame 9*a* and four driven rollers 9*b* attached at the four corners of the frames 9*a*. Accordingly, the film holder 3 is transported as being nipped between the transporting belts 8 and the driven rollers 9*b*.

The sheet-like negative film holder 3 fed in a rolled state is transported by means of transporting rollers 4 comprised of an upstream roller 4*a* and a downstream roller 4*b*. Then, at a position between these rollers 4*a*, 4*b*, the film strip 2 transported from the film positioning and transporting section F is inserted sidewise into each row pocket of the film holder 3. Then, after one order number of the film strips 2 have been inserted into the respective row pockets of the film holder 3, the trailing end of this film holder is cut by means of a cutter 7. Incidentally, the film holder transporting passage of the film holder positioning-transporting section S is formed with a forwardly downward inclination with respect to the film holder transporting direction.

Figure 4:
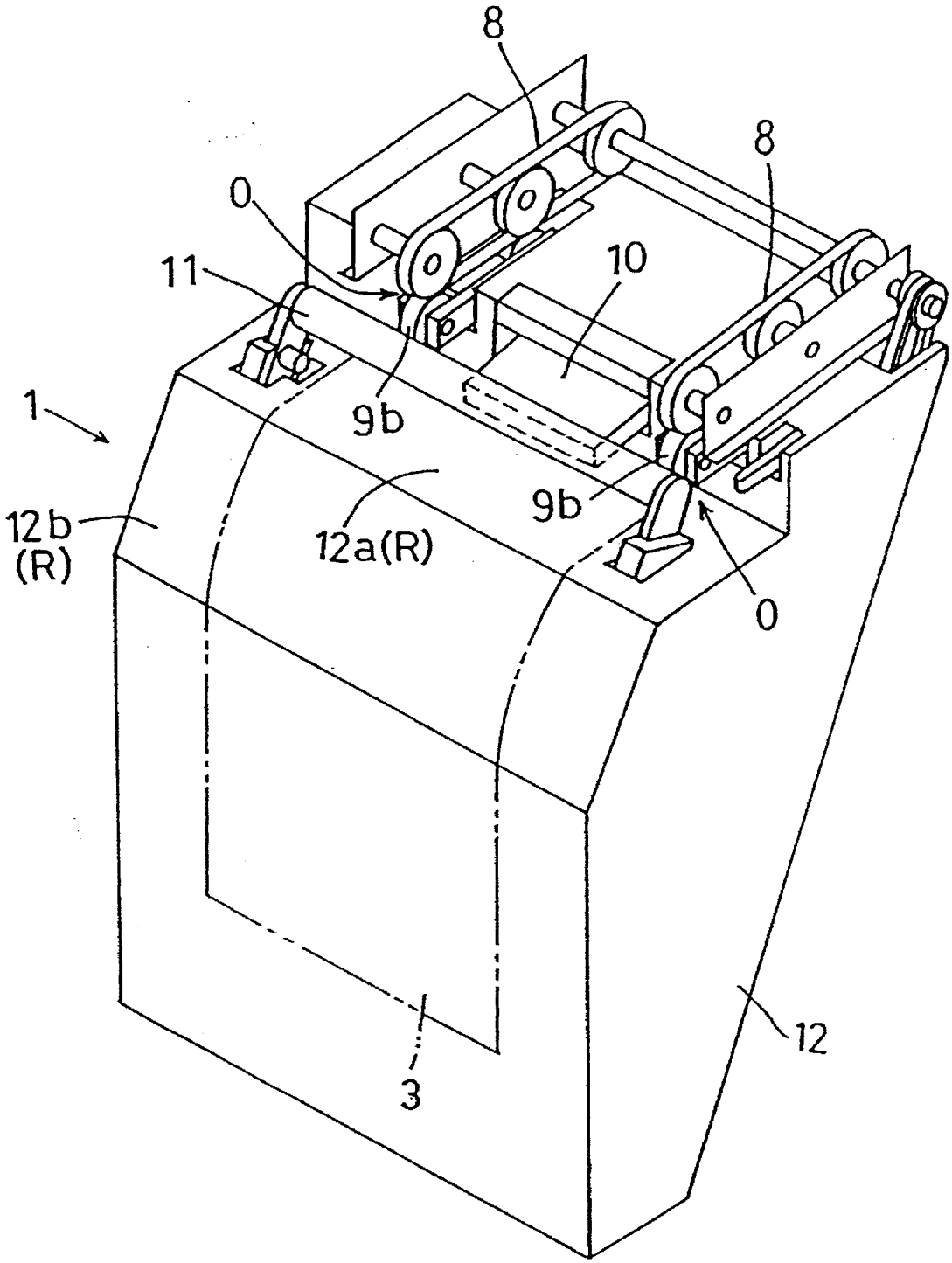
FIG. 4 is a perspective view showing an outer appearance of major portions of the apparatus shown in FIG. 1.
Figure 6:
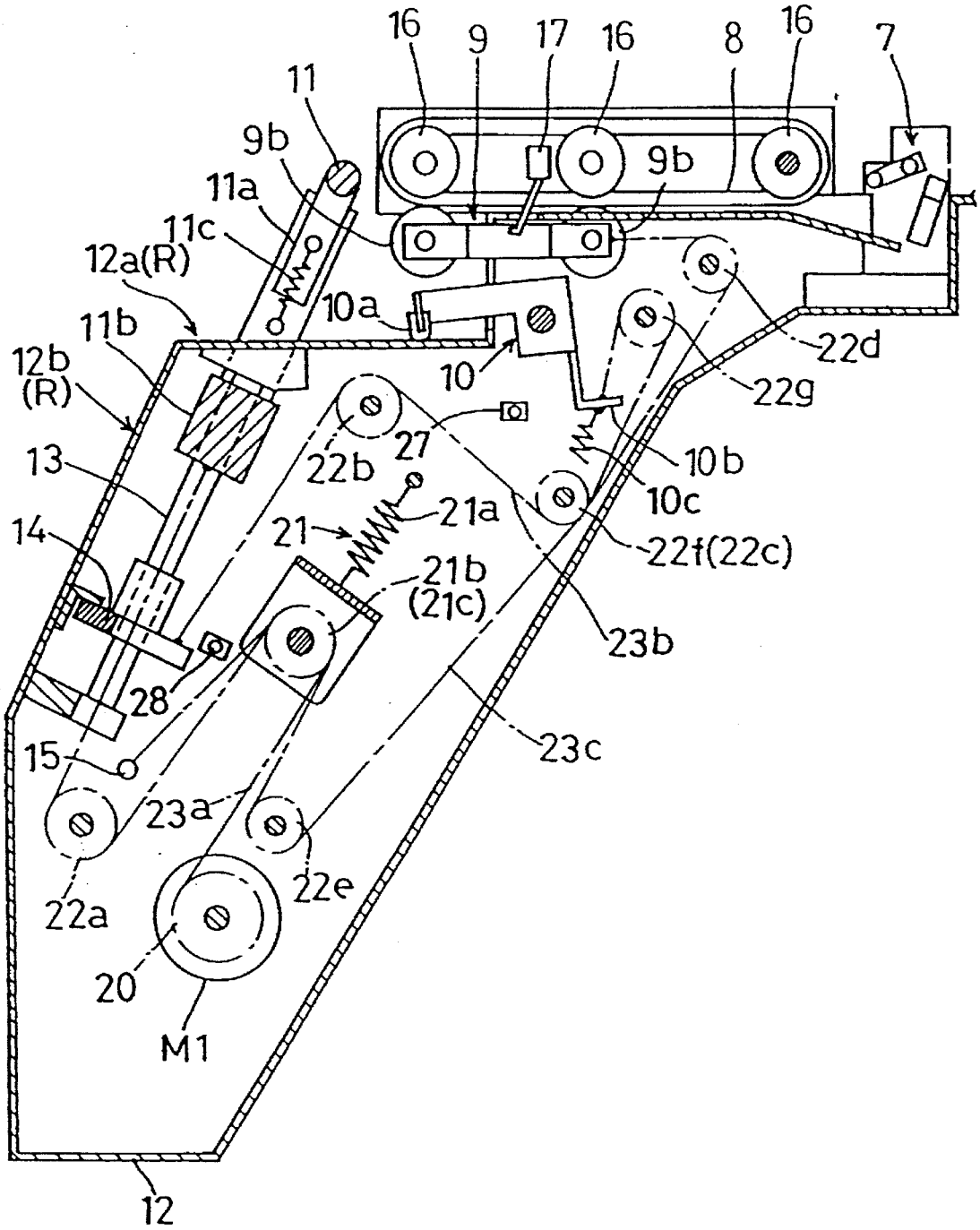
FIG. 6 is a view showing the construction of the major portions of the apparatus shown in FIG. 1, FIGS. 7 through 13 are views illustrating functions of the apparatus shown in FIG. 1.

As shown in FIGS. 4 through 6, the retaining section I includes a first retainer unit 10 disposed on the upstream side relative to the film holder transporting direction and a second retainer unit 11 disposed on the downstream side relative to the same, with the two retainer units 10, 11 being disposed one after another in the film holder transporting direction adjacent the feeding section O.

The first and second retainer units 10, 11 are disposed so as to face a horizontal face portion of a casing 12 of the retaining section I. In operation, as the first and second units 10, 11 are pressed against the horizontal face portion 12*a*, the film holder 3 interposed between the retainer units 10, 11 and the horizontal face portion 12*a* is retained therebetween.

The film holder 3 retained by the retainer units 10, 11 is supported by the upper horizontal face portion 12*a* and also by an inclined face portion 12*b* which extends from the downstream end of the upper horizontal face portion 12*a* with a downward inclination to the downstream direction of the film holder transporting direction. The upper horizontal face portion 12*a* and the inclined face portion 12*b* together function as a film holder receiving table R for supporting the film holder 3 retained by the two retainer units 10, 11.

As shown in FIGS. 5 and 6, the first retainer unit 10 is comprised of plate elements which are attached to the casing 12 and are pivotable about an axis λ. Further, a damper member 10*a* is attached to the leading end of the unit which end comes into contact with the film holder 3.

The second retainer unit 11 is comprised mainly of a bar member which is longer than the width of the film holder 3. The lateral opposed ends of the second retainer unit 11 are supported to side plates 11*a* which are slidably supported to a support member 11*b*. Connector springs 11*c* are provided at the respective connections between the side plates 11*a* and the support member 11*b* for urging the second retainer unit 11 and the side plates 11*a* toward the support member 11*b*.

The support member 11*b* is slidable along a pair of guide bars 13 extending through this support member 11*b*. The second retainer unit 11, the side plates 11*a* and the support member 11*b* are slidable together in the direction of the thickness of the negative film holder 3.

The above-described first and second retainer units 10, 11 together with the film holder support body 9, are drivably coupled via a coupling mechanism M to a motor M1 as a single actuator disposed inside the casing 12.

The coupling mechanism M includes a drive pulley 20 attached to a rotary shaft of the motor M1, a running block 21 having two driven pulleys 21*b*, 21*c* rotatable independently of each other and suspended by a spring 21*a* having one end thereof fixed to the casing 12, first though seventh driven pulleys 22*a*, 22*b*, 22*c*, 22*d*, 22*e*, 22*f*, 22*g* rotatably attached to the casing 12, a connector plate 14 disposed downwardly of the support member 11*b* connected with the second retainer unit 11 and slidable along the guide bars 13 like the support member 11*b*, a first cable 23*a* having one end thereof fixed to the drive pulley 20, extending via the driven pulley 21*b* of the running block 21 and the first driven pulley 22*a* and having the other end thereof fixed to a lower portion of the support member 11*b* connected to the second retainer unit 11, a second cable 23*b* having one end thereof fixed to the connector plate 14, extending via the second driven pulley 22*b*, the third driven pulley 22*c* and the fourth driven pulley 22*d* and having the other end thereof fixed to the upstream end of the frame member 9*a* of the film holder support body 9, and a third cable 23*c* having one end thereof fixed to a fixing pin 15 fixed to the casing 12, extending via the driven pulley 21*c* of the running block 21, the fifth driven pulley 22*e*, the sixth driven pulley 22*f* and the seventh driven pulley 22*g* and having the other end thereof fixed to an upper face of a control element 10*b* connected with the first retainer unit 10.

Of the above components of the coupling mechanism M, the second driven pulley 22*b* is comprised of an assembly of a plurality of stages of pulleys differing in diameter. And, the second cable 23*b* is connected respectively with two pulley stages of different diameters, such that an amount of movement of the connector plate 14 is magnified to move the film holder support body 9. That is, the second cable 23*b* is actually discontinuous at the connection with the second driven pulley 22*b*. Yet, for simplifying the description and illustrating of the functions, FIGS. 5 and 6 show these elements with simplification as if the second cable 23*b* were a single continuous cable and the second driven pulley 22*b* were comprised of a pulley of a single diameter.

The film holder support body 9 connected with the second cable 23*b* is urged toward the downstream side of the holder transporting direction by means of a return spring 9*c*. The first retainer unit 10 is urged, by an opening-closing spring 10*c* having one end thereof fixed to the casing 12, to be pivoted clockwise.

The support member 11*b* connected with the second retainer unit 11 and the connector plate 14 disposed downwardly of the support member 11*b* are urged to the respective upper positions by means of an unillustrated spring.

Next, there will be described functions of the automatic film inserting system 1 having the above-described construction under the control of the controller C.

When the developed film 2 is charged to the film positioning-transporting section F, the film 2 is cut into film strips each having four or six frames to be transported, as described hereinbefore. These cut film strips are inserted into the film holder 3 which is being transported by the film holder positioning-transporting section S. In this, after each film strip 2 is inserted into a row pocket of the film holder 3, the film holder 3 is transported by one row amount by the transporting rollers 4.

After the film strips 2 have been inserted into the film holder 3, the film holder 3 is further transported by the transporting belts 8 to reach the retaining section I.

After completion of the insertion of one order amount of film strips 2, when a rear end of the one order amount of film holder 3 reaches the position of the film holder cutter 7, the cutter 7 is activated to cut the film holder 3.

As this one order amount of film holder 3 is further transported and the rear end of this holder 3 is detected by a rear-end sensor 17, the motor M2 is stopped to stop the transportation of the film holder 3. At this time, the transportation is stopped before the rear end of the film holder 3 exits from the feeding section O, and the film holder support body 9 is set by the urging force of the return spring 9*c* to a position shown in FIGS. 5 and 8, where the rear end of the film holder 3 is retained between the transporting belts 8 and the film holder support body 9. That is, the film holder support body 9 is set at a supporting position for supporting the film holder 3.

Figure 7:
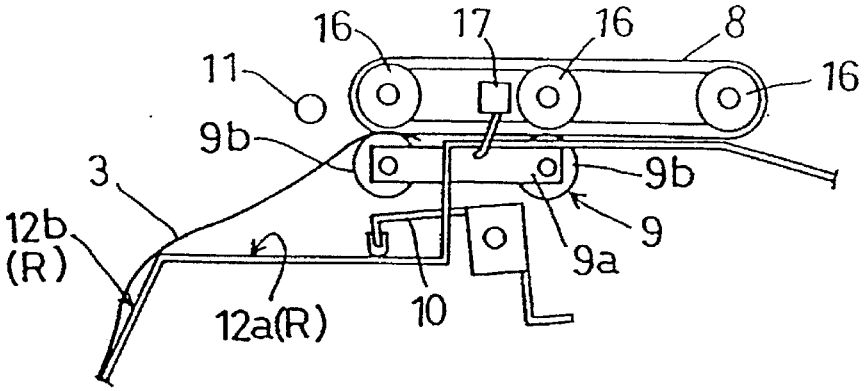

On the other hand, in the retaining section when this section is about to receive the film holder 3 fed from the feeding section O, as illustrated in FIG. 7, the first retainer unit 10 is set to the retaining position in which the unit 10 is pressed against the upper horizontal face portion 12*a* of the casing 12, while the second retainer unit 11 is set to the non-retaining position in which the unit 11 is moved upwards in the direction of the thickness of the film holder.

After the reception of the film holder 3 from the feeding section O, the motor M1 is driven to rotate in the direction of arrow A in FIG. 5 to start retrieving the first cable 23*a*.

Figure 8:
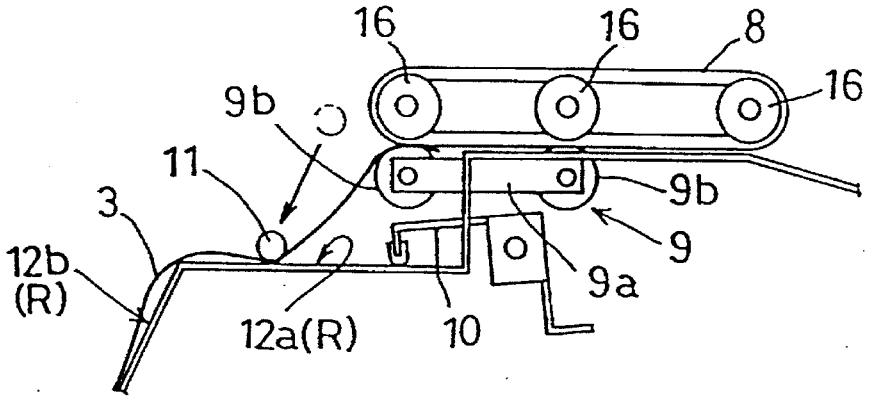

As the first cable 23*a* is retrieved, the support member 11*b* connected to the second retainer unit 11 is lowered against the urging force of the unillustrated spring. As a result, as illustrated in FIG. 8, the second retainer unit 11 too is lowered to the retaining position where the unit 11 presses the film holder 3 against the upper horizontal face portion 12*a* of the casing 12.

Figure 9:
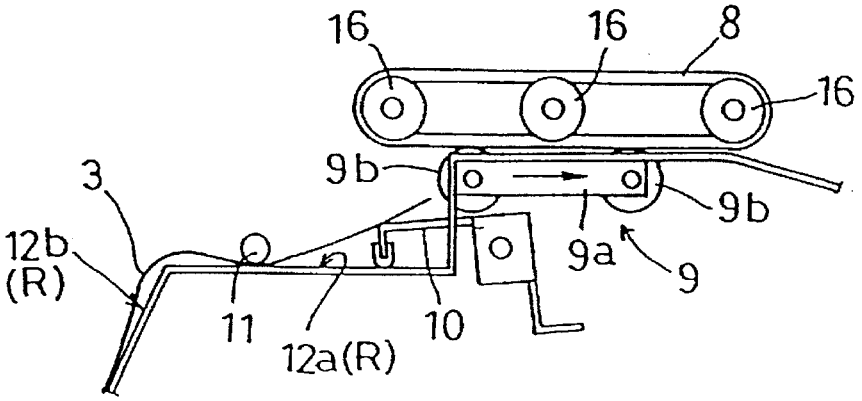

As the motor M1 further retrieves the first cable 23*a*, the support member 11*b* movable relative to the second retainer unit 11 is further lowered to depress the connector plate 14. With this depression of the connector plate 14, as illustrated in FIG. 9, the second cable 23*b* is lowered thereby to pull, via the second through fourth driven pulleys 22*b*, 22*c*, 22*d*, the film holder support body 9 to the upstream side in the holder transporting direction, so that the support body 9 comes to assume a non-supporting position for the film holder 3.

With the above, the rear end of the film holder retained between the transporting belts 8 and the film holder support body 9 is allowed to drop onto the first retainer unit 10.

Figure 10:
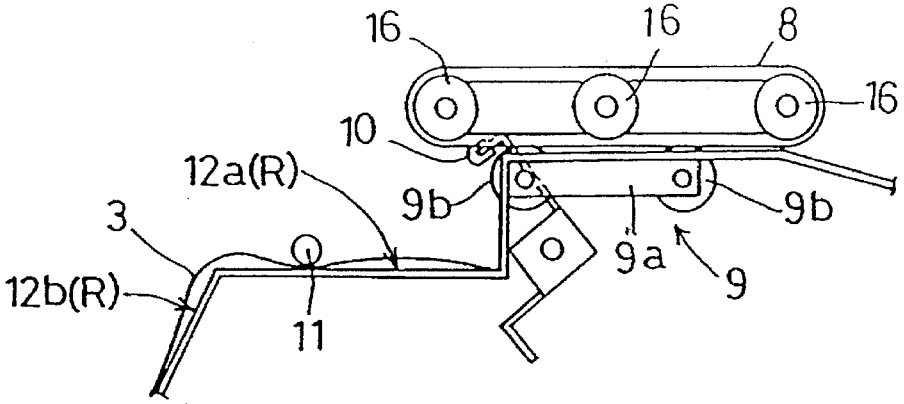

Then, as the motor M1 further retrieves the first cable 23*a*, the running block 21 is lowered against the urging force of the spring 21*a*. With this lowering of the running block 21, the third cable 23*c* is released from tensions whereby the first retainer unit 10 is pivoted about the axis λ by the urging force of the opening-closing spring 10*c* attached to the control member 10*b* as shown in FIG. 5. That is to say, with its movement to the upstream side of the holder transporting direction, the first retainer unit 10 is switched over from the retaining position to the non-retaining position as shown in FIG. 10. At this time, the film holder previously dropped onto the first retainer unit 10 is caused to drop onto the upper horizontal face portion 12*a* of the casing 12.

When an opening-closing sensor 27 detects the control member 10*b* in association with the clockwise pivotal movement of the first retainer unit 10, the motor M1 is stopped and then driven in the opposite direction.

Figure 11:
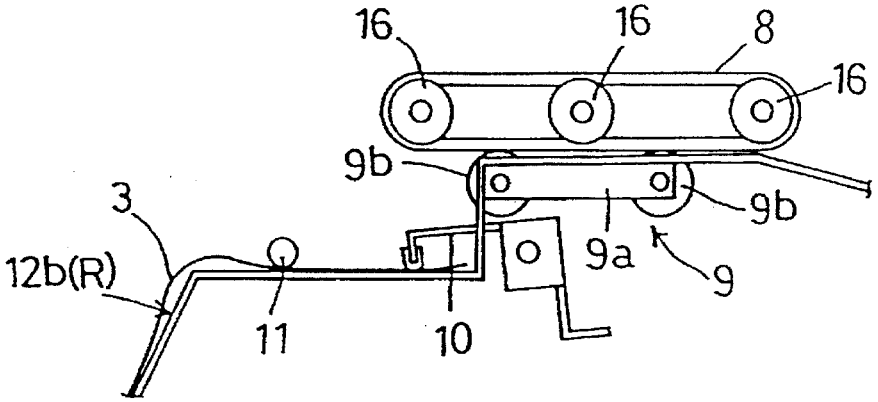

With the reversing of the rotation of the motor M1, the running block 21 starts moving upwards by the urging force of the spring 21*a* to pull the third cable 23*c*. Then, the first retainer unit 10 is pivoted counterclockwise to assume the retaining position, so that the unit 10 depresses and retains the film holder 3 against the upper horizontal face portion 12*a* of the casing 12 as shown in FIG. 11.

As the motor M1 further continues its reverse rotation, the support member 11*b* connected to the second retainer unit 11 is raised to raise the connector plate 14.

Figure 12:
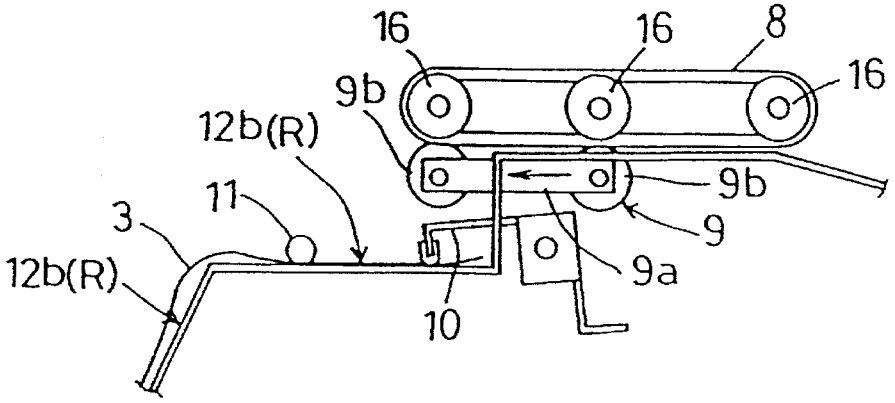

With this rising movement of the connector plate 14, the second cable 23*b* is released from the tension, so that the film holder support body 9 is caused, by the urging force of the return spring 9*c*, to the downstream position shown in FIG. 12, i.e. the supporting position for supporting the film holder 3.

Figure 13:
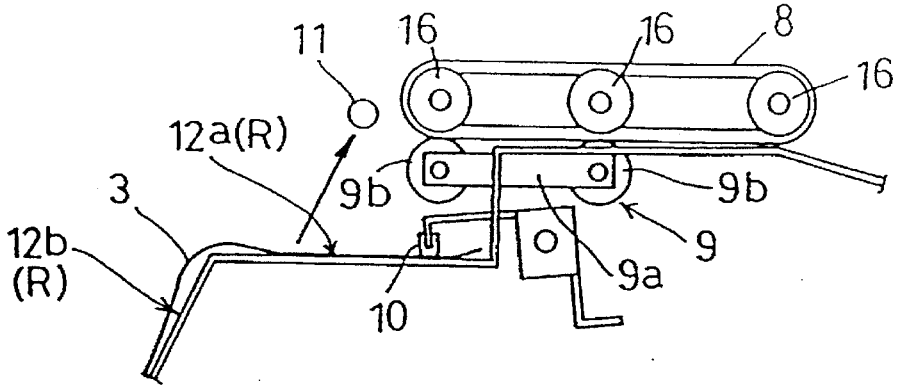

Further, as the support member 11*b* is raised, as shown in FIG. 13, the second retainer unit 11 is raised in the direction of the thickness of the film holder 3, such that the unit 11 is switched over from the retaining position to the non-retaining position.

The reverse rotation of the motor M1 is stopped when a stand-by position sensor 28 (FIG. 6) detects an unillustrated control member attached to the support member 11*b*.

In this condition, the apparatus is ready for receiving a further film holder 3 to be newly fed from the feeding section O.

Accordingly, the motor M1 and the coupling mechanism M together function as a retaining unit drive means G for drivably switching over the first and second retainer units 10, 11 between the retaining position and the non-retaining position respectively and function also as feeding section drive means H for drivably switching over the film holder support body 9 between the supporting position and the non-supporting position.

A further embodiment of the present invention will be described next.

Figure 14:
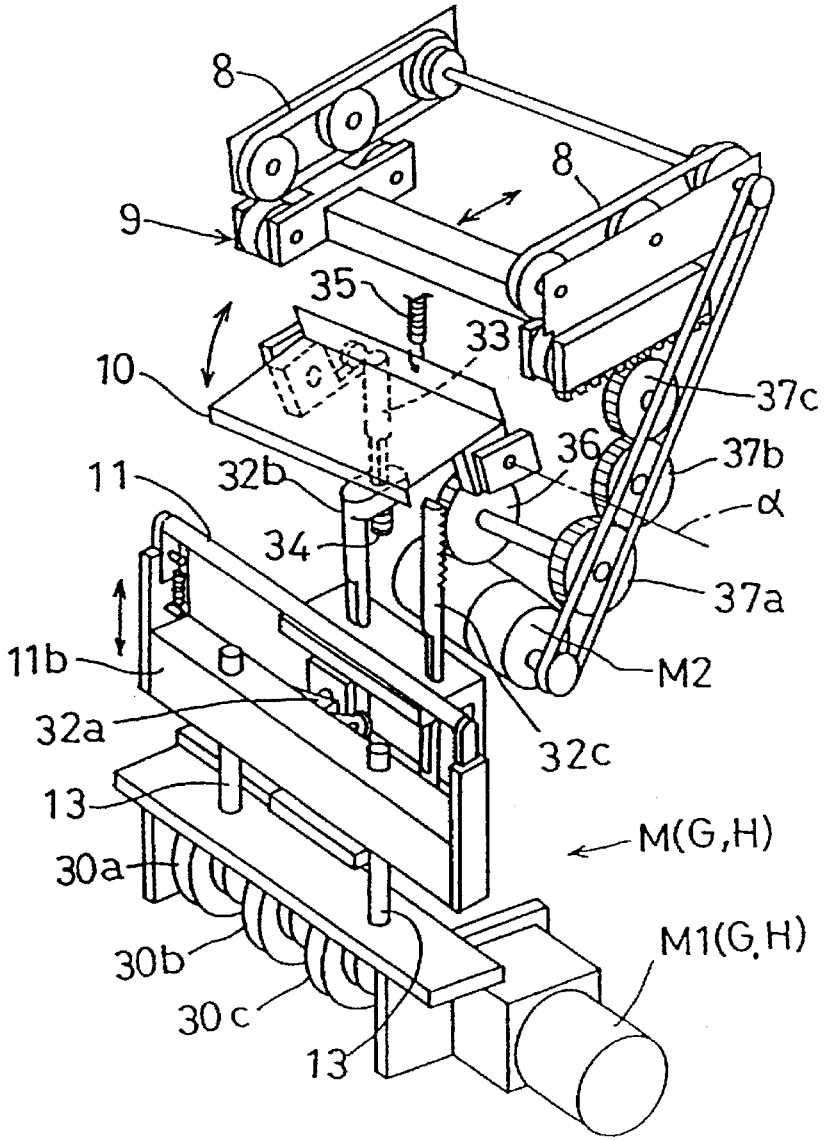
FIG. 14 is a schematic construction view showing major portions of an apparatus relating to a further embodiment of the invention.
Figure 15:
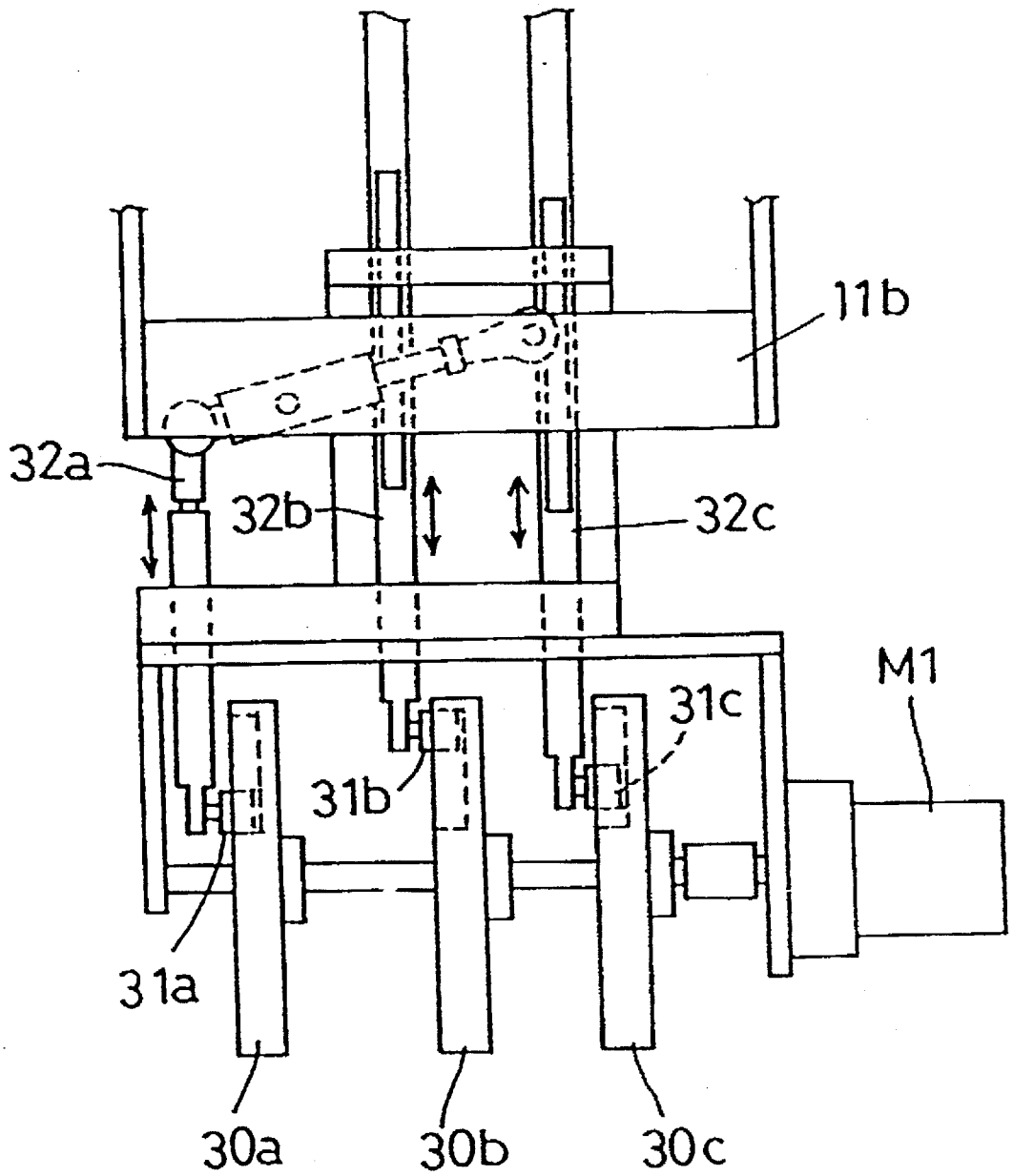
FIG. 15 is a view showing the construction of the major portions of the apparatus shown in FIG. 14.

In the foregoing embodiment, the coupling mechanism M for coupling the first and second retainer units 10, 11 and so on comprises the first through third cables 23*a*, 23*b*, 23*c*. Instead, as shown in FIGS. 14 and 15, this coupling mechanism can comprise a cam coupling mechanism.

That is, the rotary shaft of the motor M1 as the single common actuator is a camshaft which carries first through third cams 30*a*, 30*b*, 30*c*, so that these cams 30*a*, 30*b*, 30*c* are driven together by the motor M1.

The first cam 30*a* functions to vertically move the second retainer unit 11 in the direction of the thickness of the film holder 3. This first cam 30*a* is operatively connected to the support member 11*b* via a first cam roller 31*a* engaging a cam surface of the first cam 30*a* and vertically movable in association with rotation of the first cam 30*a* and a first connector arm 32*a*.

The second cam 30*b* functions to pivot the first retainer unit 10 about the pivot axis λ. This second cam 30*b* is operatively connected to the first retainer unit 10 via a second cam roller 31*b* engaging a cam surface of the second cam 30*b* and vertically movable in association with rotation of the second cam 30*b*, a second connector arm 32*b* and also a connector rod 33 vertically slidable relative to an upper end of the second connector arm 32*b*.

Incidentally, the second connector arm 32*b* and the connector rod 33 are connected via a spring 34 having one terminal end thereof fixed to the upper end of the second connector arm 32*b* and the other end thereof fixed to the lower end of the connector rod 33. To the upstream end of the first retainer unit 10, there is fixed a lower end of a spring 35 having its upper end fixed to the casing 12. This spring 35 urges the first retainer unit 10 to pivot counterclockwise about the pivot axis λ.

The third cam 30*c* functions to transport the film holder support body 9 in the film holder transporting direction. This third cam 30*c* is operatively connected to the film holder support body 9 via a third cam roller 31*c* engaging a cam surface of the third cam 30*c* and vertically movable in association with rotation of the third cam 30*c*, a third connector arm 32*c*, a pinion 36 meshing with a rack portion formed in the upper end of the third connector arm 32*c*, a first gear 37*a* rotatable in unison with the pinion 36, a second gear 37*b* meshing with the first gear 37*a*, and a third gear 37*c* meshing with a rack portion defined at a portion of a lower face of the film holder support body 9.

Next, functions of the coupling mechanism M having the above-described construction will be briefly described.

First, under the initial condition, like the condition shown in FIG. 7, the first retainer unit 10 is set to the retaining position and the second retainer unit 11 is set to the non-retaining position.

Under the condition in which the film holder support body 9 is set to the supporting position for supporting or retaining the rear end of the film holder 3 in cooperation with the transporting belts 8, the motor M2 is stopped to temporarily stop the transportation of the film holder 3. Then, the motor M1 is driven to rotate the first through third cams 30*a*, 30*b*, 30*c*.

With the above-described rotation, first the first cam roller 31*a* of the first cam 30*a* is lowered, so that the second retainer unit 11 connected to the support member 11*b* is lowered to the retaining position to press and retain the film holder 3 against the upper horizontal face portion 12*a* of the casing, as illustrated in FIG. 8. In the course of the above, the second and third cam rollers 30*b*, 30*c* are placed with a predetermined distance from the rotary shaft of the motor M1.

As the motor M1 further continues its rotation, the third cam roller 31*c* of the third cam 30*c* is moved upwards so as to move the film holder support body 9 to the non-supporting position on the upstream side in the film holder transporting direction as illustrated in FIG. 9. In the course of this, the first and second cam rollers 30*b*, 30*c* are placed respectively with a predetermined distance from the rotary shaft of the motor M1.

With further rotation of the motor M1, the second cam roller 31*b* of the second cam 30*b* is lowered, so that, as illustrated in FIG. 10, the first retainer unit 10 is pivoted clockwise to the retaining position against the urging force of the spring 35. As the motor M1 continues its rotation thereafter, the second cam roller 31*b* is switched over to move upwards, so that, as illustrated in FIG. 11, the first retaining unit 10 is pivoted counterclockwise to the retaining position to press and retain the rear end of the film holder 3 against the upper horizontal face portion 12*a* of the casing 12. In the course of the above, the first and third cam rollers 31*a*, 31*c* are placed with a predetermined distance from the rotary shaft of the motor M1.

With further rotation of the motor M1, the third cam roller 31*c* of the third cam 30*c* is lowered; then, as illustrated in FIG. 12, the film holder support body 9 is moved to the supporting position on the downstream side of the holder transporting direction. In the course of this, the first and second cam rollers 31*a*, 31*b* are placed with a predetermined distance from the rotary shaft of the motor M1.

With still further rotation of the motor M1, the first cam roller 31*a* of the first cam 30*a* is moved upwards, so that the second retainer unit 11 is lifted up to be switched over from the retaining position to the non-retaining position as illustrated in FIG. 13. In the course of this, the second and third cam rollers 31*b*, 31*c* are placed with a predetermined distance from the rotary shaft of the motor M1.

The cam surfaces of the first through third cams 30*a*, 30*b*, 30*c* are formed such that the surfaces are changed in conditions shown in FIG. 7 to further conditions shown in FIG. 13 during one rotation of the rotary shaft of the motor M1.

A still further embodiment of the present invention will be described next.

Figure 16:
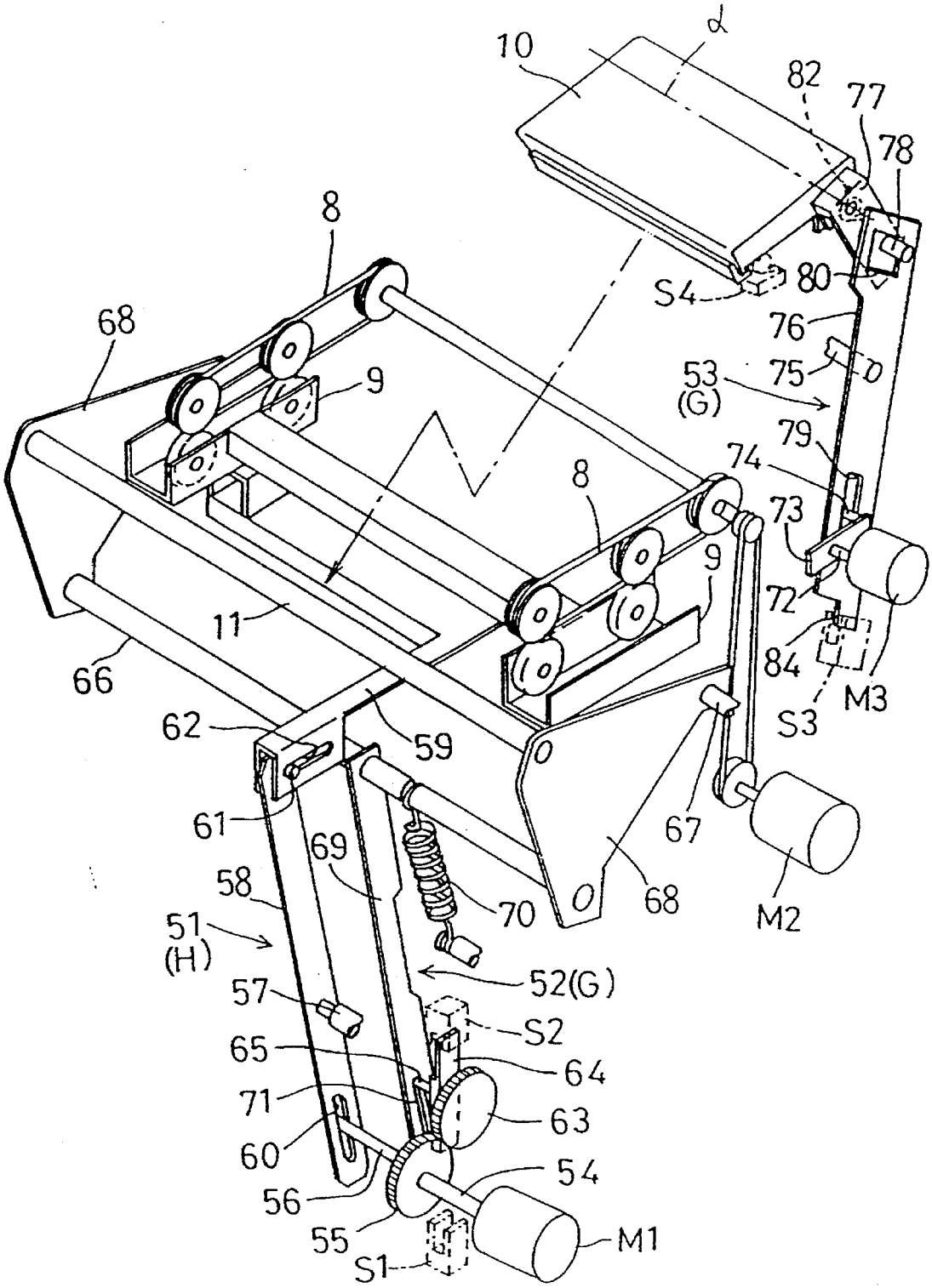
FIG. 16 is a schematic construction view showing major portions of an apparatus relating to a still further embodiment of the invention.
Figure 17:
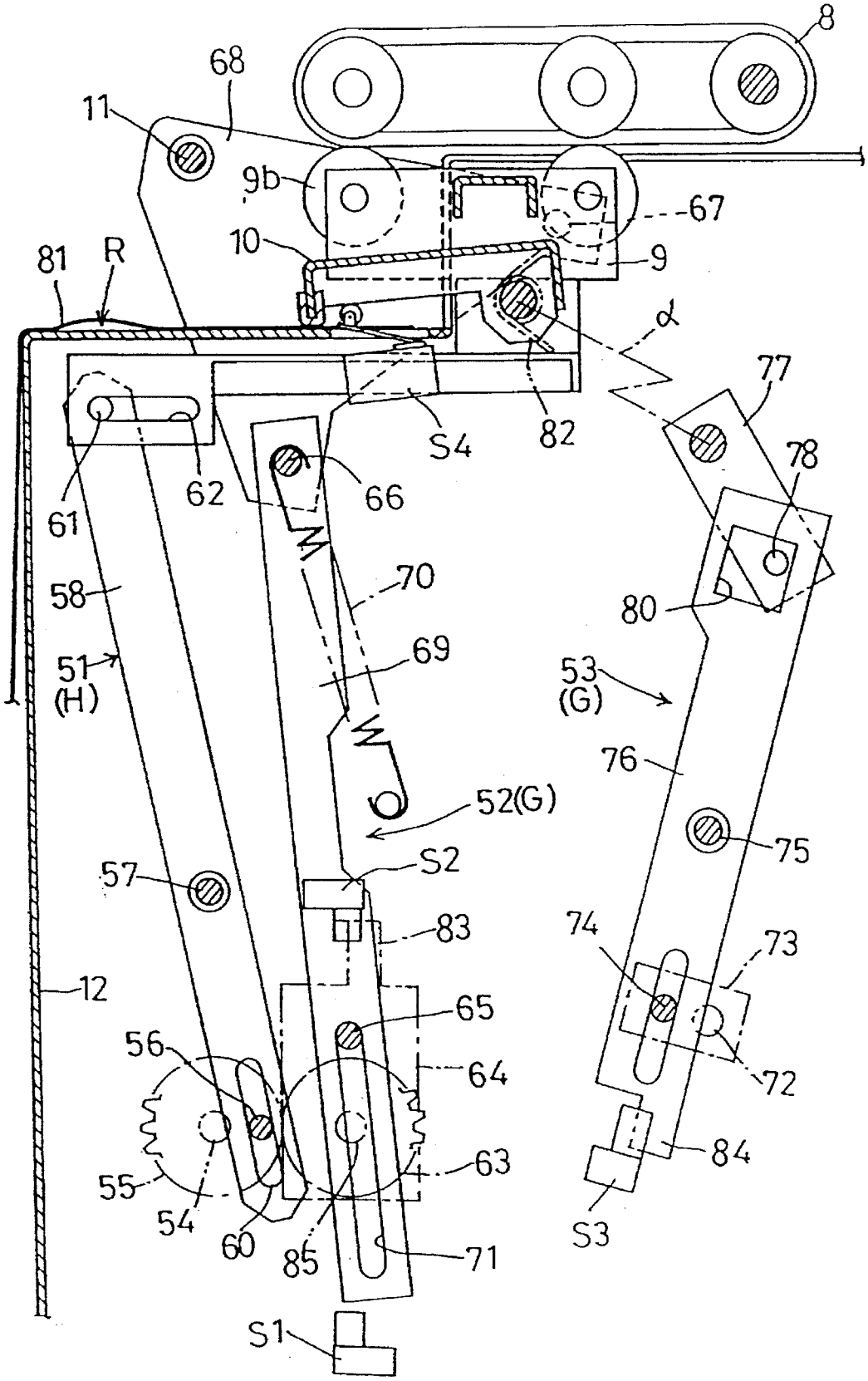
FIG. 17 is a construction view of the apparatus shown in FIG. 18, FIGS. 18(*a*) through (*f*) are views illustrating functions of the apparatus of FIG. 18, and FIGS. 19(*a*) through (*d*) are views illustrating functions of a conventional apparatus.

In this embodiment shown in FIGS. 16 and 17, the support body drive means H and the retaining section drive means G include link mechanisms 51, 52, 53.

The feeding section drive means H includes the first link mechanism 51 for switching over the film holder support body 9 between the supporting position and the non-supporting position. The retaining section drive means G includes the second link mechanism 52 for switching over the second retainer unit 11 between the retaining position and the non-retaining position and the third link mechanism 53 for switching over the first retainer unit 10 between the retaining position and the non-retaining position.

The first link mechanism 51 provides a mechanical linkage between the drive of the first motor M1 as the actuator and the film holder support body 9 for switching the position of the film holder support body. And, this first link mechanism 51 includes a first gear 55 fixed mounted on the rotary shaft 54 of the first motor M1, a crank pin 56 fixed to the first gear 55, a first link member 58 pivotably supported on a first pivot shaft 57 fixed to the casing 12, and a first arm 59 fixedly connected to the film holder support body 9. The first crank pin 56 is inserted into a first link elongate slot 60 defined at one end of the first link member 58. The first link pin 61 fixed to one end of the first link member 58 is inserted into a first arm elongate slot 62 defined in the first arm 59.

The second link mechanism 52 provides a mechanical linkage between the drive of the first motor M1 as the actuator and the second retainer unit 11 for switching the position of the second retainer unit 11. This second link mechanism 52 includes a second gear 63 meshing with the first gear 55 to be rotatable at a same rotation rate as the first gear 55 in the reverse direction about the rotary shaft 85, a second rotary arm 64 fixed to the second gear 63, a second crank pin 65 fixed to the second rotary arm 64, a pair of right and left pivot plates 68 connecting opposed ends of the second retainer unit 11 with opposed ends of a second link pin 66 to be pivotable about a second pivot shaft 67, a second link member 69 pivotably supported on the second link pin 66, and a tension coil spring 70 for urging the second retainer unit 11 to switch it over to the retaining position. The second crank pin 65 is inserted into a second link elongate slot 71 defined at one end of the second link member 69.

Accordingly, the first motor M1 functions as the single common actuator for driving both the first link mechanism 51 constituting the feeding section drive means H and the second link mechanism 52 constituting the retaining section drive means G.

The third link mechanism 53 provides a mechanical coupling between the drive of the third motor M3 as the actuator and the first retainer unit 10 for switching the position of the first retainer unit 10. This third link mechanism 53 includes a third rotary arm 73 fixed to a rotary shaft 72 of the third motor M3, a third crank pin 74 fixed to the third rotary arm 73, a third link member 76 pivotably supported on a third pivot shaft 75 fixed to the casing 12, a third arm 77 fixed to the first retainer unit 10, a pivot pin 78 fixed to the third arm 77 to be pivotable about an axis λ, and a torsion coil spring 82 for urging the first retainer unit 10 to switch it over to the retaining position. The third crank pin 74 is inserted within a third link elongate slot 79 formed at one end of the third link member 78. The pivot pin 78 is inserted within a rectangular slot 80 formed at the other end of the third link member 78.

Next, functions of the first, second and third link mechanisms 51, 52, 53 will be described with reference to FIGS. 17, 18(*a*) through (*f*).

FIG. 17 illustrates an initial condition, in which following a pivotal movement of the third link member 78, the pivot pin 78 is pivoted by the urging force of the torsion coil spring 82 to switch over the first retainer unit 10 to the retaining position, so that the first retainer unit 10 retains in a suspended state a preceding film holder 81 first fed. In this initial condition, the second retainer unit 11 is switched over to the non-retaining position by being pushed up by the second link member 89 against the urging force of the tension coil spring 70. Also, the film holder support body 9 is switched over, by the pressing force from the first link member 61 inserted within the first arm elongate slots 62, to the supporting position on the downstream side of the film holder transporting direction. The first and third motors M1, M3 are stopped.

Then, as a following film holder 3 holding one order amount of film 2 is cut by the film holder cutter 7, completion of this cutting operation is detected by an unillustrated film holder cutter sensor. Based on this detection, the second motor M2 is driven to transport this film holder 3 by the transporting belts 8. When the rear-end sensor 17 detects the rear end of the film holder, the second motor M2 is stopped, so that the film holder 3 is suspended with its rear end being nipped between the film holder support body 9 and the transporting belts 8 as illustrated in FIG. 18(*a*).

When the second motor M2 is stopped, the first motor M1 is started to be driven. With this, the first and second gears 55, 63 and the first and second crank pins 56, 65 are rotated, so that the first link member 58 is pivoted to move its first pivot pin 61 to the other end of the first arm elongate slot 62 as illustrated in FIG. 18(*b*). In association therewith, the second link member 89 is lowered by the urging force of the tension coil spring 70 to switch over the second retainer unit 11 to the retaining position.

With further rotation of the first and second gears 55, 63 and the first and second crank pins 56, 65, as illustrated in FIG. 18(c), the first link member 58 is further pivoted to cause the first link pin 61 to press the other end of the first arm elongate slot 62. Then, the film holder support body 9 is switched over to the non-supporting position on the upstream side of the film holder transporting direction, so that the rear end of the film holder 3 is allowed to drop onto the first retainer unit 10 located on the receiving table R and also the second crank pin 65 is pivoted along the second link elongate slot 71. As a first sensor S1 detects a tongue 83 of the second rotary arm 64 to determine that the second crank pin 65 has been pivoted by 180 degrees; then, based on this detection, the first motor M1 is stopped and the third motor M3 is started to be driven.

With this start of drive of the third motor M3, the third crank pin 74 is pivoted to pivot the third link member 76. Then, as illustrated in FIG. 18(*d*), the pivot pin 78 is pressed against the urging force of the torsion coil spring 82, so that the first retainer unit 10 is switched over to the non-retaining position to allow the rear end of the film holder 3 to be dropped onto the receiving table R.

Figure 18:
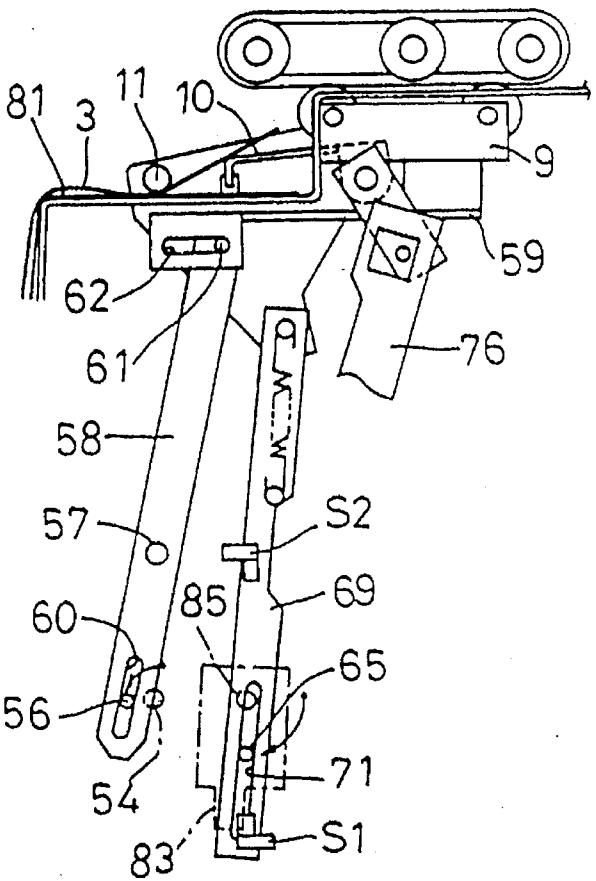
Figure 18:
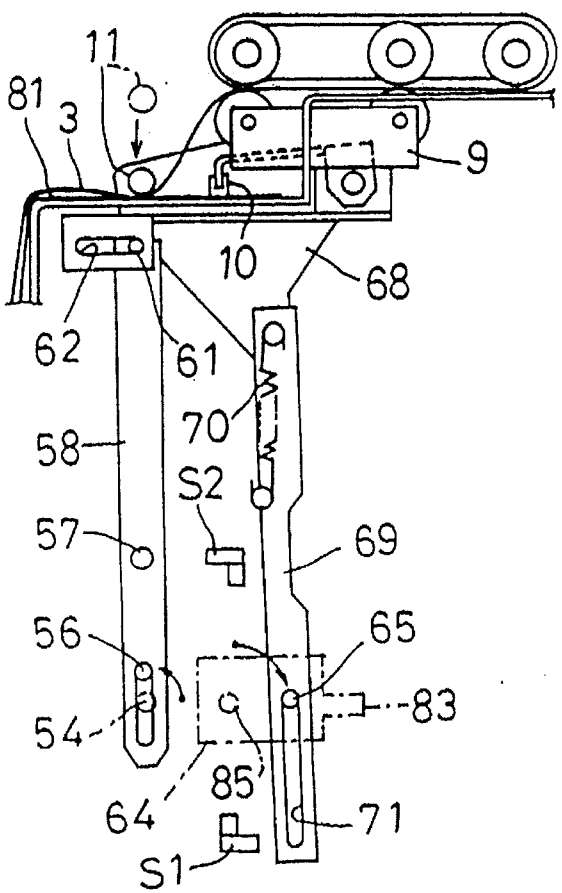
Figure 18:
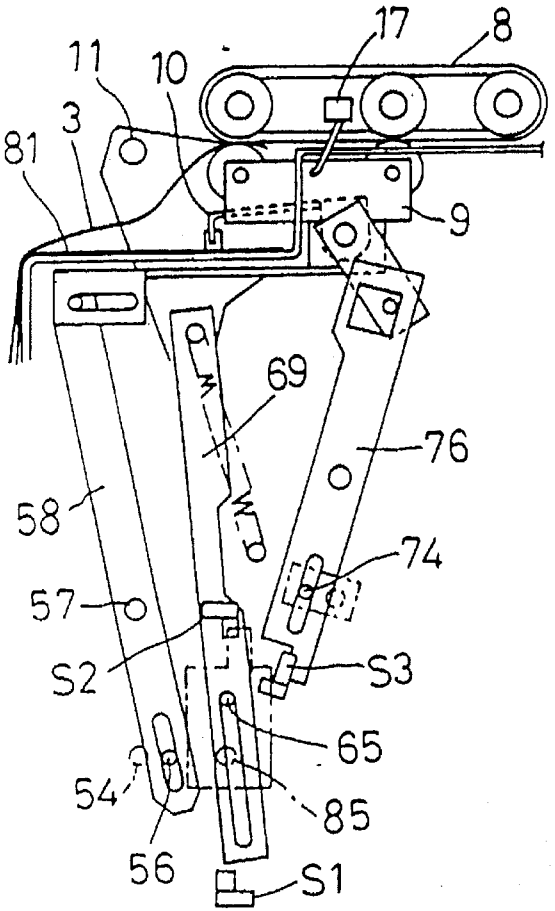
Figure 18:
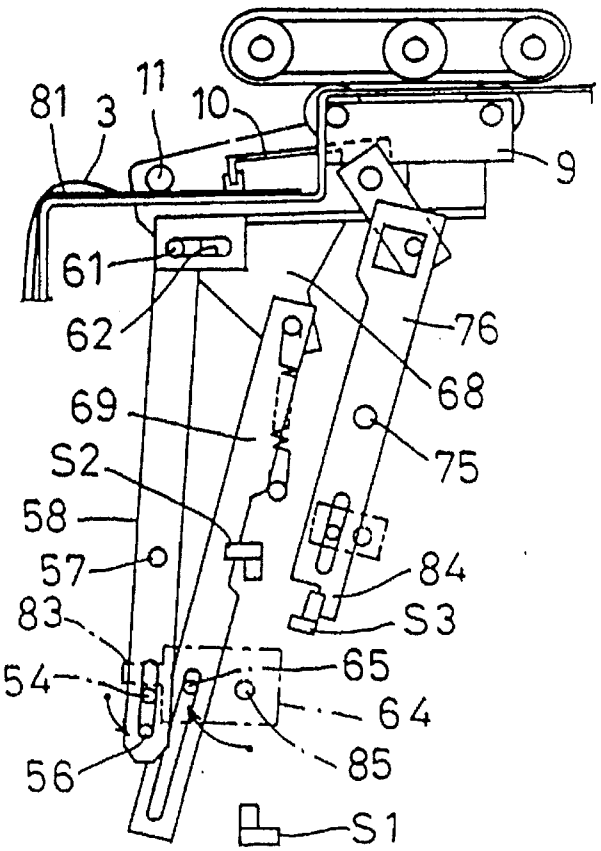
Figure 18:
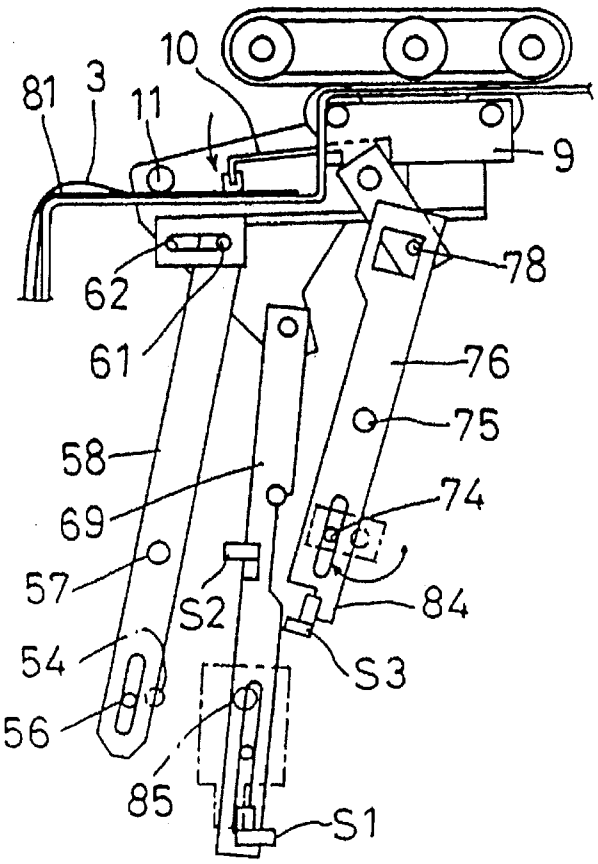
Figure 18:
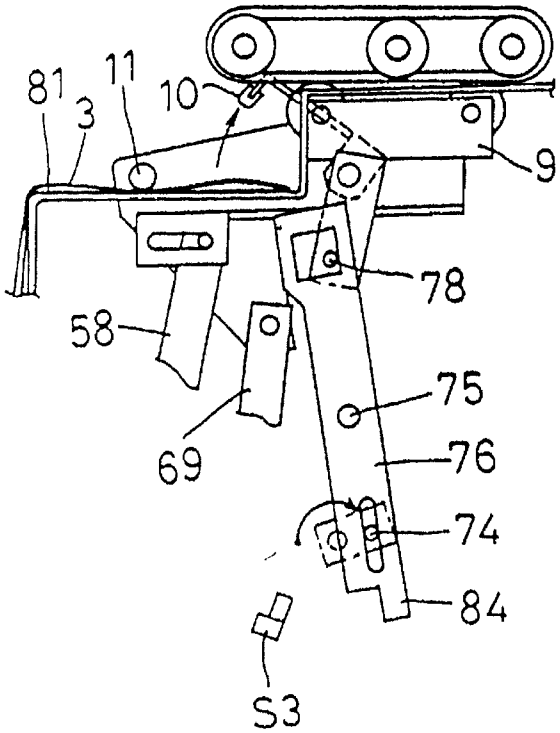
Figure 19:
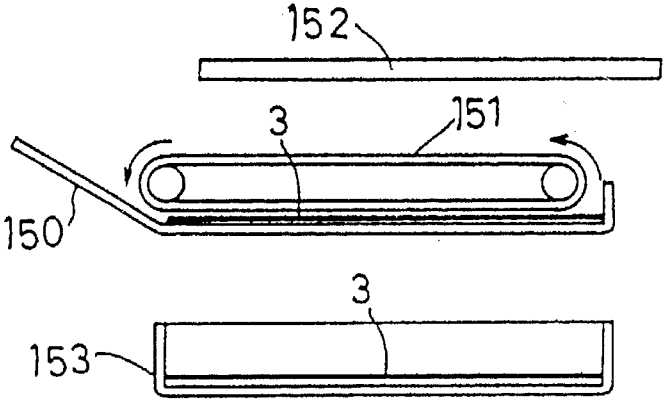
Figure 19:
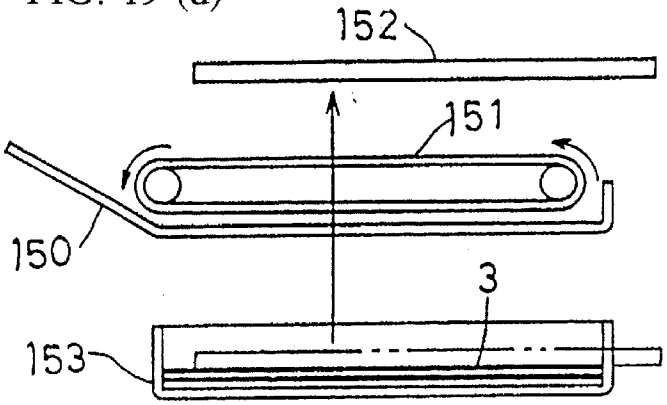
Figure 19:
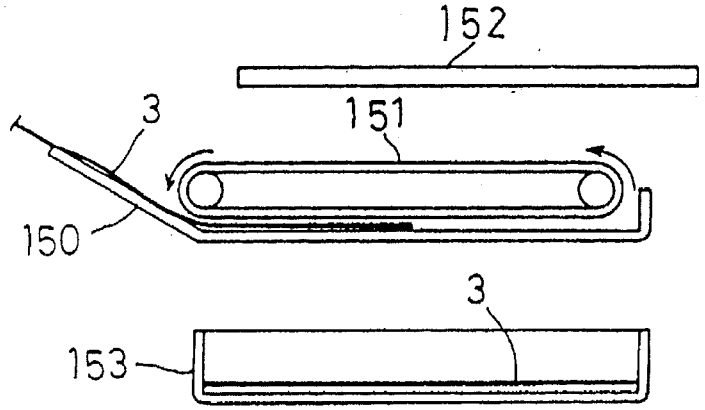
Figure 19:
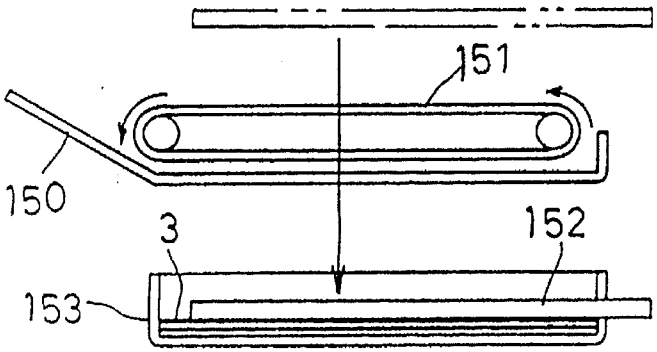

As the third crank pin 74 is further pivoted, as illustrated in FIG. 18(*e*), the third link member 76 is pivotably returned to switch over the first retainer unit 10 to the retaining position. As a third sensor S3 detects a tongue 84 of the third link member 78 to determine that the third crank pin 74 has been rotated for one complete rotation, the third motor M3 is stopped and the drive of the first motor M1 is resumed.

With this restart of the drive of the first motor M1, the first crank pin 58 and the second crank pin 85 are pivoted. Then, as illustrated in FIG. 18(*f*), the fist link member 58 is pivoted to move the first link pin 81 to one end of the first arm elongate slot 82 and also to move the second crank pin 85 along the second link elongate slot 71.

As the first crank pin 58 and the second crank pin 85 are further pivoted, the first link member 58 is also further pivoted to cause the first link pin 81 to press one end of the first arm elongate slot 82. Then, the film holder support body 9 is switched over to the supporting position on the downstream side in the film holder transporting direction, and also the second crank pin 85 pushes up the second link member 89 against the urging force of the tension coil spring 70, so that the second retainer unit 11 is switched over to the non-retaining position. As the second sensor S2 detects the tongue 83 of the second rotary arm 84 to determine that the second crank pin 85 has been rotated by one completion rotation amount, the first motor M1 is stopped, so that the apparatus is returned to the initial condition shown in FIG. 17 to be wait for transportation of a next film holder 3 containing one further amount of film.

As to the designing of configurations of the second link elongate slot 71 formed in the second link member 89 and the rectangular slot 80 defined in the third link member 78, consideration is given to the fact that the retaining thickness by the first retainer unit 10 or the second retainer unit 11 varies in accordance with the number of the sheet-like negative film holders 3, 81 to be retained such that the second link member 89 or the pivot pin 78 may be moved in accordance with such variation in the retaining thickness. In addition, further consideration is given to the safety measure against the possibility of an operator's finger being entrapped by the first retainer unit 10 or the second retainer unit 11.

Incidentally, a reference mark S4 denotes a limit switch which is turned ON with each switching-over of the first retainer unit 10 to the retaining position. In operation, based on a signal transmitted from this limit switch S4, the number of film holders 3, 81 retained by the first retainer unit 10 is counted. Then, when the counted number reaches a predetermined value, this is displayed on an unillustrated display unit.

The remaining portions of the construction of this embodiment are identical to those of the foregoing embodiment.

Some other embodiments will be specifically described next.

(1) In the foregoing embodiments, the film holder support body 9 for supporting the film holder 3 at the feeding section O is rendered movable along the film holder transporting direction, so that when the rear end of the film holder 3 is transported therefrom the rear end is allowed to drop properly onto the first retainer unit 10. Alternatively, instead of providing the movable film holder support body 9, a member may be provided for pushing the rear end of the film holder 3 back to the upstream side in the film holder transporting direction, so as to allow this rear end of the film holder 3 to be dropped properly onto the first retainer unit 10.

It is also conceivable to adapt the second retainer unit 11 to be rotatably driven, such that with feeding of the rear end of the film holder S from the feeding section O, the second retainer unit 11 set to the retaining position is rotatably driven to transport the film holder 3 thereby to allow the rear end of the film holder 3 to be properly dropped onto the first retainer unit 10.

(2) In the foregoing embodiments, when the second retainer unit 11 disposed on the downstream side of the film holder transporting direction is set to the non-retaining position, the film holder 3 is transported to be received by the retaining section I. Instead of being moved in the direction of the thickness of the film holder 3, the second retainer member 11 may be adapted to move to the right and left relative to the film holder transporting direction, or the pair of right and left pressing members may be provided to be moved to the right and left directions alternately, so that the apparatus receives the film holder 3 from the feeding section O with the second retainer unit 11 being set to the retaining position while the first retainer unit 10 disposed on the upstream side in the film holder transporting direction being set to the non-retaining position and then after the reception of the film holder 3 from the feeding section O the first retainer unit 10 is switched over to the retaining position and also the second retainer unit 11 is switched over to the non-retaining position, respectively.

(3) In the foregoing embodiments , when the retaining section I is about to receive the film holder 3 from the feeding section O, the predetermined retainer unit is set at the non-retaining position. Instead, it is also conceivable that the retainer unit to be set at the non-retaining portion when the film holder 3 is about to be received is alternated between the two retainer units.

(4) The retaining section drive means G may be provided separately for driving each of the first retainer unit 10 and the second retainer unit 11.

(5) In the foregoing embodiments, both of the retainer units 10, 11 are adapted to retain the film holder 3 by pressing the same from the above. Instead, it is also conceivable for these retainer units to retain the holder from the above and the under.

(6) In the foregoing embodiments, the motor M1 and the coupling mechanism M together function as the retaining section drive means G for switching over the first and second retainer units 10, 11 between the retaining position and the non-retaining position and function also as the feeding section drive means H for switching over the film holder support body 9 between the supporting position and the non-supporting position. Instead, these retaining section drive means G and the feeding section drive means H may be provided separately from each other.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. Apparatus for accumulating a sheet-like negative film holder for holding a plurality of negative film strips, said holder having a rear end with respect to a transport direction of the film holder, said apparatus comprising a receiving table, a feeding section for feeding the film holder in said transport direction to said receiving table, said feeding section comprising a film holder support body which is movable between a first position, wherein said support body fixes said rear end of said film holder against movement in said transport direction, and a second position, wherein said support body releases said rear end of said film holder, a first retainer unit disposed adjacent to said feed section, said first retainer unit being selectively movable between a retaining position, wherein said rear end of said film holder is fixed to said receiving table, and a releasing position, wherein said film holder can move on said receiving table, a second retainer unit disposed downstream of said first retainer unit in said transport direction, said second retainer unit being selectively movable between a retaining position, wherein said film holder is fixed to said receiving table, and a releasing position, wherein said film holder can move on said receiving table, retainer unit drive means for moving only said second retainer unit to said releasing position when said feeding section is about to feed said film holder to said receiving table, and for moving said second retainer unit to said retaining position when said feeding section has fed said film holder to said receiving table, and for moving said first retaining unit from the retainer position to the releasing position after said second retainer unit is in the retaining position, and support body drive means for moving said support body from said first position to said second position after said second retainer unit is in said retaining position.

2. Apparatus as in claim 1 wherein said support body is movable in said transport direction, said first position being downstream of said second position.

3. Apparatus as in claim 2 wherein said first retainer unit fixes said rear end of said film holder to said receiving table at a retaining point which is downstream of said second position of said support body in said transport direction.

4. Apparatus as in claim 3 wherein said feeding section overlaps said receiving table, said support body in said first position fixing said rear end of said film holder above said retaining point on said receiving table.

5. Apparatus as in claim 1 wherein said retainer unit drive means and said support body drive means comprise a common actuator which transmits a shift for moving said support body between said first position and said second position and a shift for moving at least one of said first and second retainer units between said retaining position and said releasing position.

6. Apparatus as in claim 5 wherein said support body drive means comprises a first link mechanism driven by said common actuator and said retainer unit drive means comprises a second link mechanism driven by said common actuator.

7. Apparatus as in claim 6 wherein said second link mechanism transmits a shift for moving said second retainer unit between said retaining position and said releasing position.

8. Apparatus as in claim 7 wherein said retainer unit drive means further comprises a third link mechanism which transmits a shift for moving said first retainer unit between said retaining position and said releasing position in response to movement of said common actuator.

9. Apparatus as in claim 5 wherein said retainer unit drive means and said support body drive means comprises a cable and pulley system which transmits a shift from said common actuator for moving said support body, said first retainer unit, and said second retainer unit.

10. Apparatus as in claim 5 wherein said retainer unit drive means and said support body drive means comprise a common camshaft driven by said common actuator, which common camshaft carries cams which transmit shifts for moving each of said support body, said first retainer unit, and said second retainer unit.

* * * * *

UNITED STATES PATENT AND TRADEMARK OFFICE

CERTIFICATE OF CORRECTION

PATENT NO. : 5,662,322

DATED : September 2, 1997

INVENTOR(S) : Masuo KAWAGUTI

It is certified that error appears in the above-identified patent and that said Letters Patent is hereby corrected as shown below:

On the title page, item [56] :

;U.S. PATENT DOCUMENTS, change "8/1894" to --3/1894--.

In column 2, line 4, before "parallel" insert --in--.

In column 3, lines 11-12, delete the phrase --its movement in the direction of the thickness of the--.

In column 3, line 59, change "born" to --borne--.

In column 5, line 59, after "Consequently," delete --.--.

In column 6, lines 31 and 34, change "18" to --16--.

In column 6, line 64, change "housings" to --housing,--.

In column 7, line 23, change "18" to --16--.

In column 7, line 63, after "portion" insert --12a--.

UNITED STATES PATENT AND TRADEMARK OFFICE

CERTIFICATE OF CORRECTION

PATENT NO. : 5,662,322

DATED : September 2, 1997

INVENTOR(S) : Masuo KAWAGUTI

It is certified that error appears in the above-identified patent and that said Letters Patent is hereby corrected as shown below:

In column 8, line 12, change the "λ" to an --α--.

In column 9, line 42, change "8" to --6--.

In column 9, line 47, following "section", insert --I,--.

In column 10, line 9, following "holder", insert --3--.

In column 10, line 15, change "tensions" to --tension,--.

In column 10, line 16, change the "λ" to an --α--.

In column 10, line 22, following "holder", insert --3--.

In column 11, line 18, change the "λ" to an --α--.

In column 11, line 33, change the "λ" to an --α--.

In column 12, line 58, following "body", insert --9--.

UNITED STATES PATENT AND TRADEMARK OFFICE

CERTIFICATE OF CORRECTION

PATENT NO. : 5,662,322

DATED : September 2, 1997

INVENTOR(S) : Masuo KAWAGUTI

It is certified that error appears in the above-identified patent and that said Letters Patent is hereby corrected as shown below:

In column 13, line 33, change the "λ" to an --α--.

In column 13, line 37, following "member", change "78" to --76--.

In column 13, line 39, change "78" to --76--.

In column 13, line 44, change "78" to --76--.

In column 13, line 51, change "89" to --69--.

In column 13, line 54, change "61" to --58--.

In column 14, line 7, change "89" to --69--.

In column 14, line 37, change "78" to --76--.

In column 14, line 41, change "58" to --56--.

In column 14, line 41, change "85" to --65--.

UNITED STATES PATENT AND TRADEMARK OFFICE

CERTIFICATE OF CORRECTION

PATENT NO. : 5,662,322
DATED : September 2, 1997
INVENTOR(S) : Masuo KAWAGUTI

It is certified that error appears in the above-identified patent and that said Letters Patent is hereby corrected as shown below:

In column 14, line 43, change "81" to --61--.

In column 14, line 44, change "82" to --62--.

In column 14, line 44, change "85" to --65--.

In column 14, line 46, change "58" to --56--.

In column 14, line 46, change "85" --65--.

In column 14, line 48, change "81" to --61--.

In column 14, line 49, change "82" to --62--.

In column 14, line 52, change "85" to --65--.

In column 14, line 53, change "89" to --69--.

In column 14, line 56, change "84" to --64--.

UNITED STATES PATENT AND TRADEMARK OFFICE

CERTIFICATE OF CORRECTION

PATENT NO. : 5,662,322
DATED : September 2, 1997
INVENTOR(S) : Masuo KAWAGUTI

It is certified that error appears in the above-identified patent and that said Letters Patent is hereby corrected as shown below:

In column 14, line 57, change "85" to --65--.

In column 14, line 63, change "89" to --69--.

In column 14, line 64, change "78" to --76--.

In column 15, line 2, change "89" to --69--.

In column 15, line 34, change "S" to --3--.

In Claim 1, column 16, line 57, delete the phrase "first retaining unit from the retainer position" and insert therefor --first retainer unit from the retaining position--.

Signed and Sealed this

Eighth Day of June, 1999

*Attest:*

Q. TODD DICKINSON

*Attesting Officer*

*Acting Commissioner of Patents and Trademarks*